US005515920A

United States Patent [19]

Luk et al.

[11] Patent Number: 5,515,920

[45] Date of Patent: May 14, 1996

[54] HIGH PROPPANT CONCENTRATION/HIGH $CO_2$ RATIO FRACTURING SYSTEM

[75] Inventors: Samuel W. M. Luk; John L. Grisdale, both of Calgary, Canada

[73] Assignee: Canadian Fracmaster Ltd., Canada

[21] Appl. No.: 330,373

[22] Filed: Oct. 27, 1994

[30] Foreign Application Priority Data

Aug. 5, 1994 [CA] Canada ..... 2129613

[51] Int. Cl.[6] ..... E21B 43/267

[52] U.S. Cl. ..... 166/280; 166/177.5; 166/30.2; 507/924

[58] Field of Search ..... 166/177, 280, 166/302, 308; 507/922, 924

[56] References Cited

U.S. PATENT DOCUMENTS

| | | | |
|---|---|---|---|
| Re. 32,302 | 12/1986 | Almond et al. | 166/308 |
| 3,310,112 | 1/1967 | Nielson et al. | 166/280 |
| 4,374,545 | 2/1983 | Bullen et al. | 166/280 |
| 4,569,394 | 2/1986 | Sweatman et al. | 166/280 |
| 4,627,495 | 12/1986 | Harris et al. | 166/280 |
| 4,780,243 | 10/1988 | Edgley et al. | 166/280 X |

FOREIGN PATENT DOCUMENTS

| | | |
|---|---|---|
| 687938 | 3/1963 | Canada . |
| 745453 | 3/1963 | Canada . |
| 932655 | 3/1971 | Canada . |
| 1043091 | 9/1974 | Canada . |
| 1034363 | 2/1978 | Canada . |
| 1134258 | 9/1981 | Canada . |
| 1241826 | 1/1985 | Canada . |
| 1242389 | 3/1986 | Canada . |
| 1197977 | 10/1988 | Canada . |

*Primary Examiner*—George A. Suchfield
*Attorney, Agent, or Firm*—Lerner, David, Littenberg, Krumholz & Mentlik

[57] ABSTRACT

There is described a method of fracturing an underground formation penetrated by a well bore comprising the steps of forming a first pressurized stream of liquified gas, introducing proppants into the first stream for transport of the proppants in the first stream, pressurizing and cooling the proppants to substantially the storage pressure and temperature of the liquified gas prior to introducing the proppants into the first stream, forming a second pressurized stream of fracturing fluid, introducing proppants into the second stream for transport therein, and admixing the first and second streams to form an emulsion for injection into the formation at a rate and pressure to cause the fracturing thereof.

32 Claims, 4 Drawing Sheets

HIGH PROPPANT CONCENTRATION/HIGH $CO_2$ RATIO FRACTURING SYSTEM

FIELD OF THE INVENTION

This invention relates to the art of hydraulically fracturing subterranean earth formations surrounding oil wells, gas wells and similar bore holes. In particular, this invention relates to hydraulic fracturing utilizing a two phase fluid having a high carbon dioxide ratio with improved proppant concentrations.

BACKGROUND OF THE INVENTION

Hydraulic fracturing has been widely used for stimulating the production of crude oil and natural gas from wells completed in reservoirs of low permeability. Methods employed normally require the injection of a fracturing fluid containing suspended propping agents into a well at a rate sufficient to open a fracture in the exposed formation. Continued pumping of fluid into the well at a high rate extends the fracture and leads to the build up of a bed of propping agent particles between the fracture wells. These particles prevent complete closure of the fracture as the fluid subsequently leaks off into the adjacent formations and results in a permeable channel extending from the well bore into the formations. The conductivity of this channel depends upon the fracture dimensions, the size of the propping agent particles, the particle spacing and the confining pressures.

The fluids used in hydraulic fracturing operations must have fluid loss values sufficiently low to permit build up and maintenance of the required pressures at reasonable injection rates. This normally requires that such fluids either have adequate viscosities or other fluid loss control properties which will reduce leak-off from the fracture into the pores of the formation.

Fracturing of low permeability reservoirs has always presented the problem of fluid compatibility with the formation core and formation fluids, particularly in gas wells. For example, many formations contain clays which swell when contacted by aqueous fluids causing restricted permeability, and it is not uncommon to see reduced flow through gas well cores tested with various oils.

Another problem encountered in fracturing operations is the difficulty of total recovery of the fracturing fluid. Fluids left in the reservoir rock as immobile residual fluids impede the flow of reservoir gas or fluids to the extent that the benefit of fracturing is decreased or eliminated. The removal of the fracturing fluid may require the expenditure of a large amount of energy and time, consequently the reduction or elimination of the problem of fluid recovery and residue removal is highly desirable.

In attempting to overcome the fluid loss problems, gelled fluids prepared with water, diesel, methyl alcohol and similar low viscosity liquids have been useful. Such fluids have apparent viscosities high enough to support the proppant materials without settling and also high enough to prevent excessive leak-off during injection. The gelling agents also promote laminar flow under conditions where turbulent flow would otherwise take place and hence in some cases, the pressure losses due to fluid friction may be lower than those obtained with low viscosity-base fluids containing no additives. Certain water-soluble, poly-acrylamides, oil soluble poly-isobutylene and other polymers which have little effect on viscosity when used in low concentration can be added to the ungelled fluid to achieve good friction reduction.

In attempting to overcome the problem of fluid compatibility when aqueous fracturing fluids are used, chemical additives have been used such as salt or chemicals for pH control. Salts such as NaCl, KCl or $CaCl_2$ have been widely used in aqueous systems to reduce potential damage when fracturing water sensitive formations. Where hydrocarbons are used, light products such as gelled condensate have seen a wide degree of success, but are restricted in use due to the nature of certain low permeability reservoirs.

Low density gases such as $CO_2$ or $N_2$ have been used in attempting to overcome the problem of removing the fracturing liquid. The low density gases are added at a calculated ratio which promotes fluid flow subsequent to fracturing. This back flow of load fluids is usually due to reservoir pressure alone without mechanical aid from the surface because of the reduction of hydrostatic head caused by gasifying the fluid.

Moreover, low density liquified gases have themselves been used as fracturing fluids. Reference is made to Canadian Patents 687,938 and 745,453 to Peterson who discloses a method and apparatus for fracturing underground earth formations using liquid $CO_2$. Peterson recognized the advantages of liquid $CO_2$ as a means to avoid time consuming and expensive procedures involved in the recovery of more conventional fracturing fluids. Peterson however does not disclose the use of entrained proppants in conjunction with liquid $CO_2$. The combination of a liquid $CO_2$ fracturing fluid and propping agents has been described by Bullen in Canadian Patent 932,655 wherein there is described a method of entraining proppants in a gelled fluid, typically a gelled methanol, which is mixed with liquid carbon dioxide and injected into low permeability formations. The liquid carbon dioxide is allowed to volatize and bleed off and the residual liquid, primarily methyl alcohol, is in part dissolved by formation hydrocarbons and allowed to return to the surface as vapor, the balance, however, being recovered as a liquid using known recovery techniques. Clearly, it has been demonstrated that the need to use a gelled carrier fluid has resulted in the negation of some of the fluid recovery advantages attendant upon the use of liquified gas fracturing fluids.

Subsequent disclosures have been primarily concerned with the development of more advantageous gelled fluids to entrain proppants for subsequent or simultaneous blending with the liquified carbon dioxide fracturing fluid. Reference is made to Canadian Patents 1,000,483 (reissued as Canadian Patent 1,034,363), 1,043,091, 1,197,977, 1,241,826 and 1,242,389 in this regard. Each of these patents teaches the nature and composition of gelled or ungelled carrier fluids, typically methanol or water based, which, when blended with liquid $CO_2$, produce a two-phase liquid system which allegedly is useful in attempting to overcome the problems of fluid compatibility with formation fluids while at the same time being capable of transporting increased concentrations of proppant material into the fracture zones.

From the foregoing, it will be readily appreciated that the use of liquid $CO_2$ as a fracturing agent is known. It is further known to use other liquids having propping agents entrained therein for blending with the liquified gas fracturing fluid. The propping agents are subsequently deposited in the liquid or foam-formed fractures for the purpose of maintaining flow passages upon rebound of the fracture zone. It is further known that proppant materials can be introduced into a liquid carbon dioxide system if a gelled liquid, usually alcohol or water-based, is mixed with the $CO_2$ to impart sufficient viscosity to the mixture to support proppant particles. Typically, although such mixtures can initially be characterized by a high liquid $CO_2$ ratio, that is, the ratio of $CO_2$ volume to the conventional frac fluid in the two phase system is high, incremental increases in proppant concentrations as the fracturing process progresses results in $CO_2$ displacement, causing substantial declines in liquid $CO_2$ volumes. Large residual liquid fractions must then be recovered from the fracture zones and risks of contamination increase substantially. Declining liquid $CO_2$ ratios also mean reduced fracture conductivity.

In Canadian Patent 1,134,258 belonging to the assignee herein, it has been recognized that proppant materials can be introduced directly into a liquid carbon dioxide stream using little or no other viscosifying liquid components while still transporting significant quantities of up to 800 kg/m$^3$ (and more in some situations) of proppant material into the fracture zones. This has been achieved by pressurizing and cooling the proppants to substantially the storage pressure and temperature of the liquified $CO_2$ prior to blending of the two for injection down the well bore.

SUMMARY OF THE INVENTION

Current job requirements often specify proppant concentrations in excess of 800 kg/m$^3$ but there is a demand as well for sustained qualities (that is, the ratio of $CO_2$ volume to the volume of liquid $CO_2$ and conventional frac fluid combined) of in excess of 70 to 75 percent (%) while delivering up to 2400 kg/m$^3$ (and perhaps more) of proppant. None of the systems referred to in the aforementioned patents is capable of this kind of performance.

Accordingly, it is an object of the present invention to provide a fracturing fluid and a method of hydraulic fracturing utilizing liquid carbon dioxide in a two-phase liquid system providing both high downhole proppant concentrations while maintaining high liquid $CO_2$ ratios.

In a preferred aspect of the present invention, these objects are achieved by adding proppants to both the $CO_2$ and the conventional frac fluid, which may be either water, alcohol or hydrocarbon-based, prior to admixture of the two streams to form an emulsion for injection down the well bore.

According to the present invention then, there is provided a method of fracturing an underground formation penetrated by a well bore comprising the steps of forming a first pressurized stream of liquified gas, introducing proppants into said first stream for transport of said proppants in said first stream, pressurizing and cooling said proppants to substantially the storage pressure and temperature of said liquified gas prior to introducing said proppants into said first stream, forming a second pressurized stream of fracturing fluid, introducing proppants into said second stream for transport therein, and admixing said first and second streams to form an emulsion for injection into said formation at a rate and pressure to cause the fracturing thereof.

BRIEF DESCRIPTION OF THE DRAWINGS

Embodiments of the invention will now be described in greater detail and will be better understood when read in conjunction with the following drawings, in which.

DETAILED DESCRIPTION

It will be appreciated by those skilled in the art that a number of different liquified gases having suitable viscosities and critical temperatures may be utilized as fracturing fluids. For purposes of illustration, however, and having regard to the cost and safety advantages afforded by the use of carbon dioxide, reference will be made herein to the use of liquified carbon dioxide as the principal liquified gas fracturing agent of the present hydraulic fracturing method.

As the basic method of combining proppant material with liquid $CO_2$ referred to in Canadian Patent 1,134,258 is a component of the present invention, it will be useful to redescribe that process in considerable detail herein as follows. It will be understood that the following description is intended to be exemplary in nature and is not limitative of the present invention. Other means of combining liquid $CO_2$ with proppants may occur to those skilled in the art as will alternative apparati.

Figure 1:
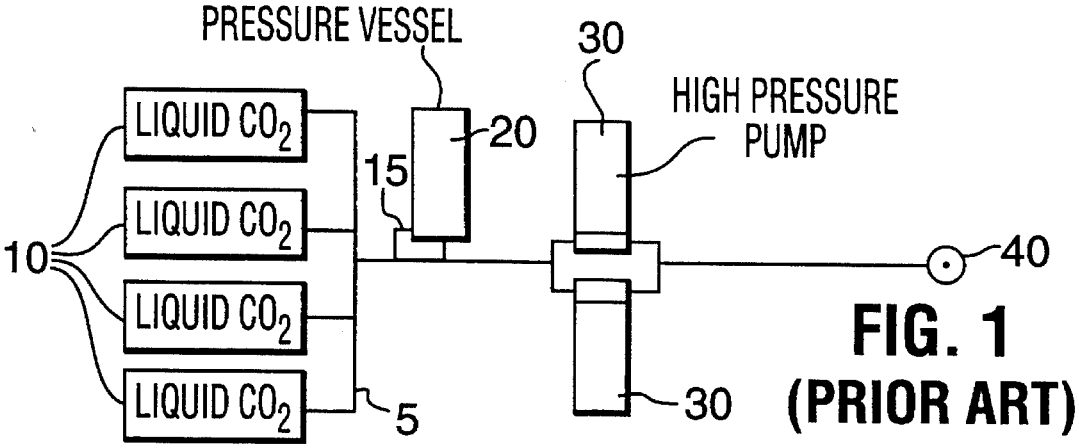
FIG. 1 (PRIOR ART)
FIG. 1 is a block diagram of the hydraulic fracturing system combining proppants with liquid $CO_2$.
Figure 2:
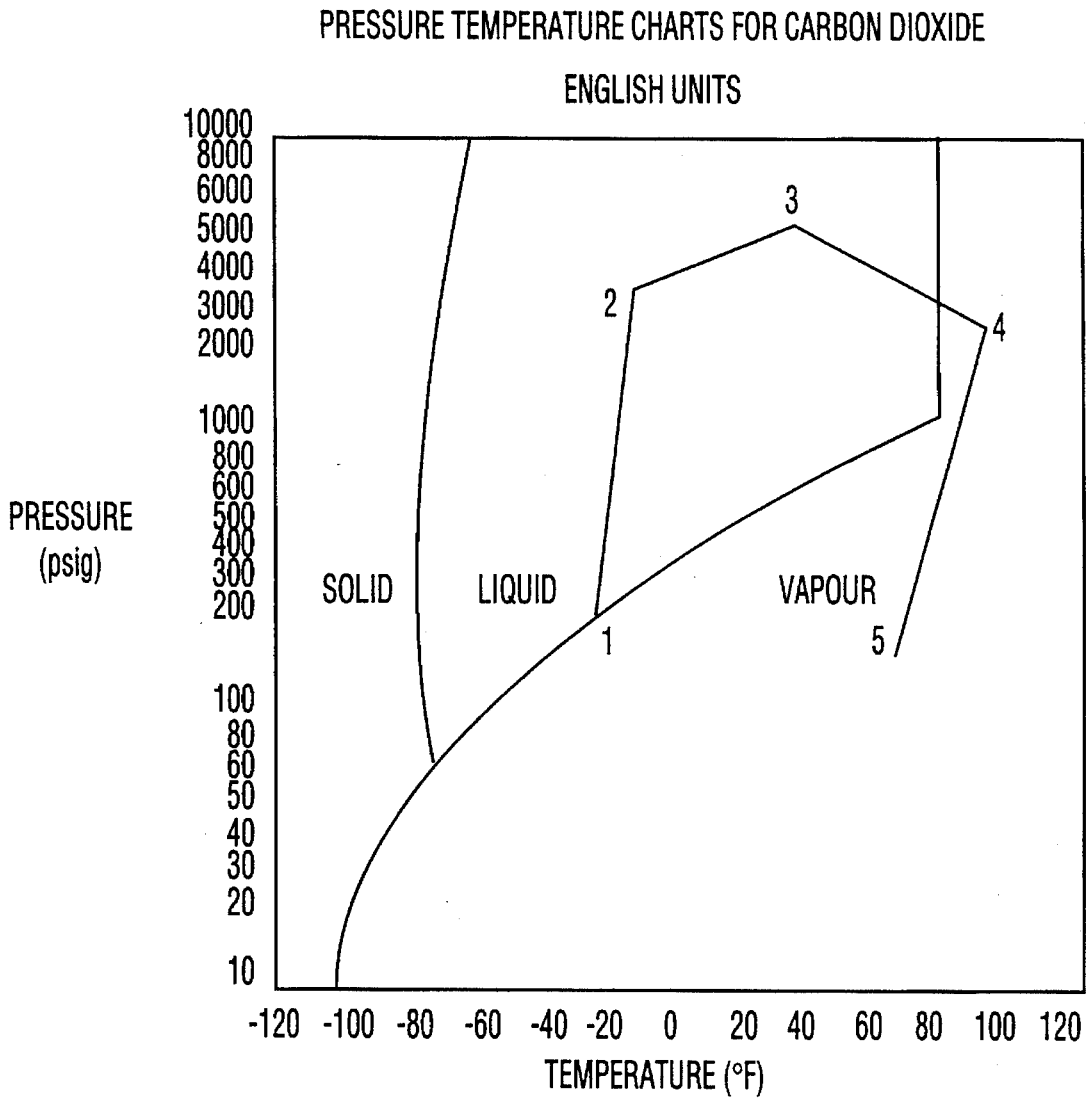
FIG. 2 (PRIOR ART)
FIG. 2 is a pressure-temperature plot for $CO_2$ in the region of interest with respect to the method of well fracturing illustrated in FIG. 1.
Figure 5:
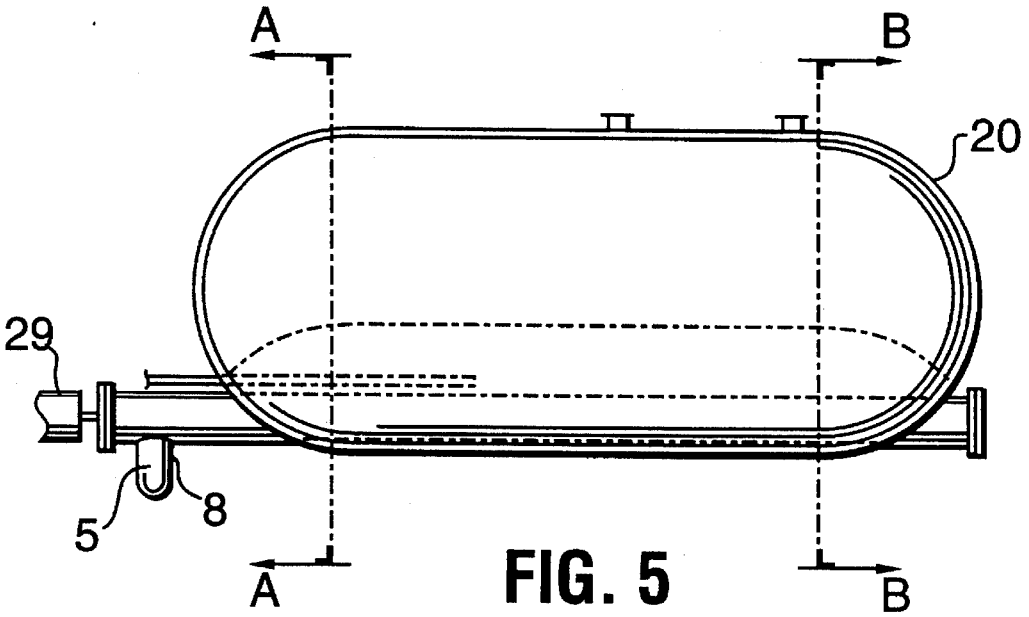
FIG. 5 (PRIOR ART)
FIG. 5 is a more detailed view of the tank of FIGS. 3 and 4.
Figure 5A:
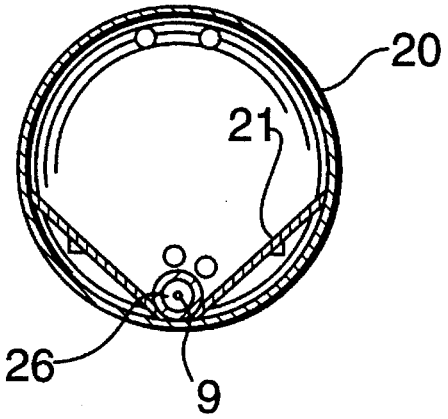
FIG. 5a (PRIOR ART)
Figure 5B:
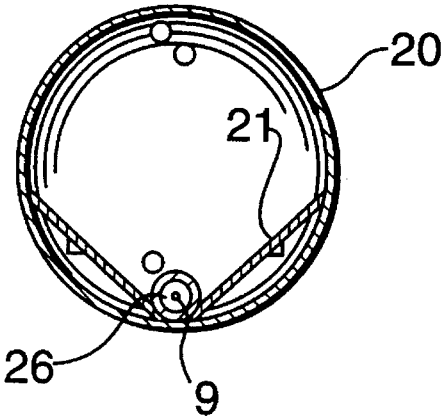
FIG. 5b (PRIOR ART)

Referring to FIGS. 1 and 2 together, liquified $CO_2$ and proppants are transported to a well site. At the site, the liquified $CO_2$ is initially maintained at an equilibrium temperature and pressure of approximately −25° F. and at 200 psi (#1 in FIG. 2) in a suitable storage vessel or vessels 10 which may include the transport vehicle(s) used to deliver the liquified gas to the site. The proppants are also stored in a pressure vessel 20. The proppants are pressurized and cooled using some liquid $CO_2$ from vessels 10 introduced into vessel 20 via manifold or conduit 5 and tank pressure line 15. In this manner, the proppants are cooled to a temperature of approximately −25° F. and subjected to a pressure of approximately 200 psi.

Liquid $CO_2$ vaporized by the proppant cooling process is vented off and a ½ to ¾ capacity (FIG. 3) level 24 of liquid $CO_2$ is constantly maintained in vessel 20 so as to prevent the passage of vapor downstream to the high pressure pumps 30 used to inject the fracture fluids into the well bore 40. Pumps 30 are of conventional or known design so that further details thereof have been omitted from the present description.

Prior to the commencement of the fracturing process, the liquid $CO_2$ stored in vessels 10 is pressured up to approximately 300 to 350 psi, that is, about 100 to 150 psi above equilibrium pressure, so that any pressure drops or temperature increases in the manifolds or conduits between vessels 10 and pumps 30 will not result in the release of vapor but will be compensated for to ensure delivery of $CO_2$ liquid to frac pumps 30. Methods of pressuring up the liquid $CO_2$ are well known and need not be described further here.

Liquified $CO_2$ is delivered to pumps 30 from vessels 10 along a suitable manifold or conduit 5. Pumps 30 pressurize the liquified $CO_2$ to approximately 2,500 to 10,000 psig or higher, the well-head injection pressure. The temperature of the liquid $CO_2$ increases slightly as a result of this pressurization.

The horizon to be fractured is isolated and the well casing adjacent the target horizon is perforated in any known fashion. The liquid $CO_2$ is pumped down the well bore 40, through the perforations formed into the casing and into the formation. With reference to FIG. 2, the temperature of the $CO_2$ increases as it travels down the well bore due to the absorption of heat from surrounding formations. It will therefore be appreciated that the $CO_2$ must be pumped at a sufficient rate to avoid prolonged exposure of the $CO_2$ in the well bore to formation heat sufficient to elevate the temperature of the $CO_2$ beyond its critical temperature of approximately 88° F.

Methods of calculating rates of heat adsorption and appropriate flow rates are well known and therefore will not be elaborated upon here. It will in any event be appreciated that with continued injection, the temperature of surrounding pipes and formations are reduced to thereby minimize vapor losses during injection.

Pressurization of the $CO_2$ reaches a peak (3) at the casing perforations and declines gradually as the $CO_2$ moves laterally into the surrounding formations. Fracturing is accomplished of course by the high pressure injection of liquified $CO_2$ into the formations. After pumping is terminated the pressure of the carbon dioxide bleeds off to the initial pressure of the formation and its temperature rises to the approximate initial temperature of the formation.

During the fracturing process, of course, the liquified carbon dioxide continues to absorb heat until its critical temperature (87.8° F.) is reached whereupon the carbon dioxide volatilizes. Volatilization is accompanied by a rapid increase in $CO_2$ volume which may result in increased fracturing activity. The gaseous $CO_2$ subsequently leaks off or is absorbed into surrounding formations. When the well is subsequently opened on flow back, the carbon dioxide exhausts itself uphole due to the resulting negative pressure gradient between the formation and the well bore.

As mentioned above, the propping agents are cooled to the approximate temperature of the liquified $CO_2$ prior to introduction of the proppants into the $CO_2$ stream. The heat absorbed from the proppants would otherwise vaporize a percentage of the liquid $CO_2$, eliminating its ability to adequately support the proppants at typical pumping rates and which could create efficiency problems in the high pressure pumpers. The specific heat of silica sand proppant is approximately 0.2 BTU/lb/°F. The heat of vaporization of $CO_2$ at 250 psig is approximately 100 BTU/lb. To cool silica sand proppant from a 70° F. transport temperature to the liquid $CO_2$ temperatures of −25° F. will therefore require the vaporization of approximately 0.2 lb of $CO_2$ for each 1 lb of sand so cooled.

Figure 3:
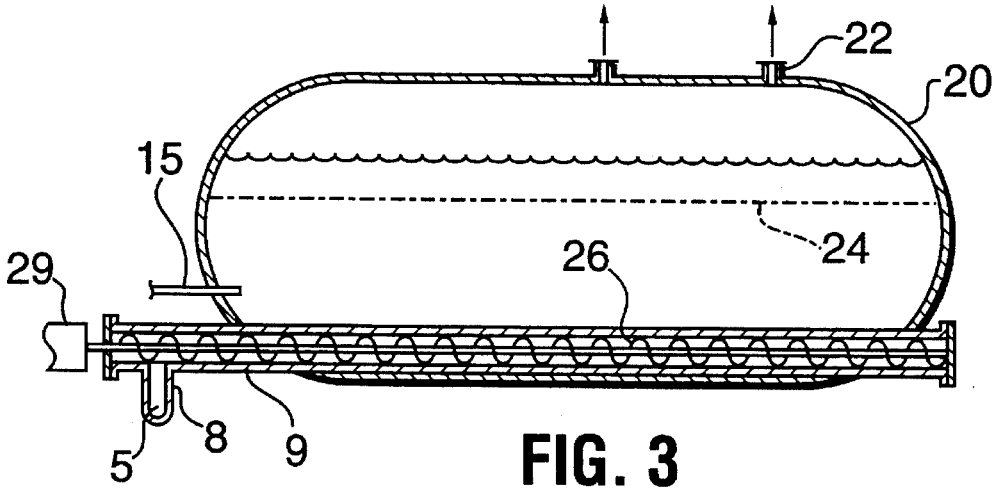
FIG. 3 (PRIOR ART)
FIG. 3 is a sectional view taken along the longitudinal axis of the proppant tank illustrated schematically in FIG. 1.
Figure 4:
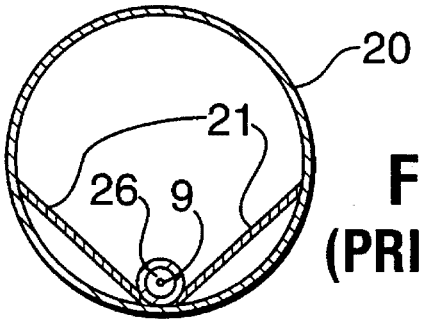
FIG. 4 (PRIOR ART)
FIG. 4 is a partially sectional view of the proppant tank of FIG. 3.

Reference is now made to FIGS. 3 and 4 which illustrates proppant pressure vessel and blender (tank) 20 in greater detail. The liquid carbon dioxide used to pressurize and cool the enclosed proppants is introduced into tank 20 via pressure line 15 and the excess vapors generated by the cooling process are allowed to escape through vent 22. Liquid $CO_2$ operating level 24 prevents an excess accumulation of vapors and further isolates the vapors from the proppants transported along the bottom of tank 20 towards the liquid $CO_2$ stream passing through conduit 5.

Tank 20 may be fitted with baffle plates 21 to direct the proppants toward a helically wound auger 26 passing along the bottom of tank 20 in a direction towards conduit 5 via an auger tube 9. Auger drive means 29 of any suitable type are utilized to rotate auger 26. Auger tube 9 opens downwardly into a chute 8 communicating with conduit 5 so that proppants entrained along the auger are introduced into the $CO_2$ stream passing through the conduit. It will be appreciated that the pressure maintained in tube 9 equals or exceeds that in conduit 5 to prevent any blow back of the liquid $CO_2$.

It will be appreciated that tank 20 may be of any suitable shape and feed mechanisms other than the one illustrated utilizing auger 26 may be employed, a number of which, including gravity feed mechanisms, will occur to those skilled in the art.

After sufficient liquified carbon dioxide has been injected into the well to create a fracture in the target formation, cooled proppants from pressurized proppant tank 20 may be introduced into the streams of liquid carbon dioxide to be carried into the fracture by the carbon dioxide. The proppants may include silica sand of 40/60, 20/40 and 10/20 mesh size. Other sizes and the use of other materials is contemplated depending upon the requirements of the job at hand.

It will be appreciated that if so desired, cooled proppants may be introduced into the carbon dioxide stream simultaneously with the initial introduction of the liquified carbon dioxide into the formation for fracturing purposes.

Upon completion of fracturing, the well may be shut in to allow for complete vaporization of the carbon dioxide and to allow formation rebound about the proppants. The well is then opened on flow back and $CO_2$ gas is allowed to flow back and exhaust to the surface.

Figure 6:
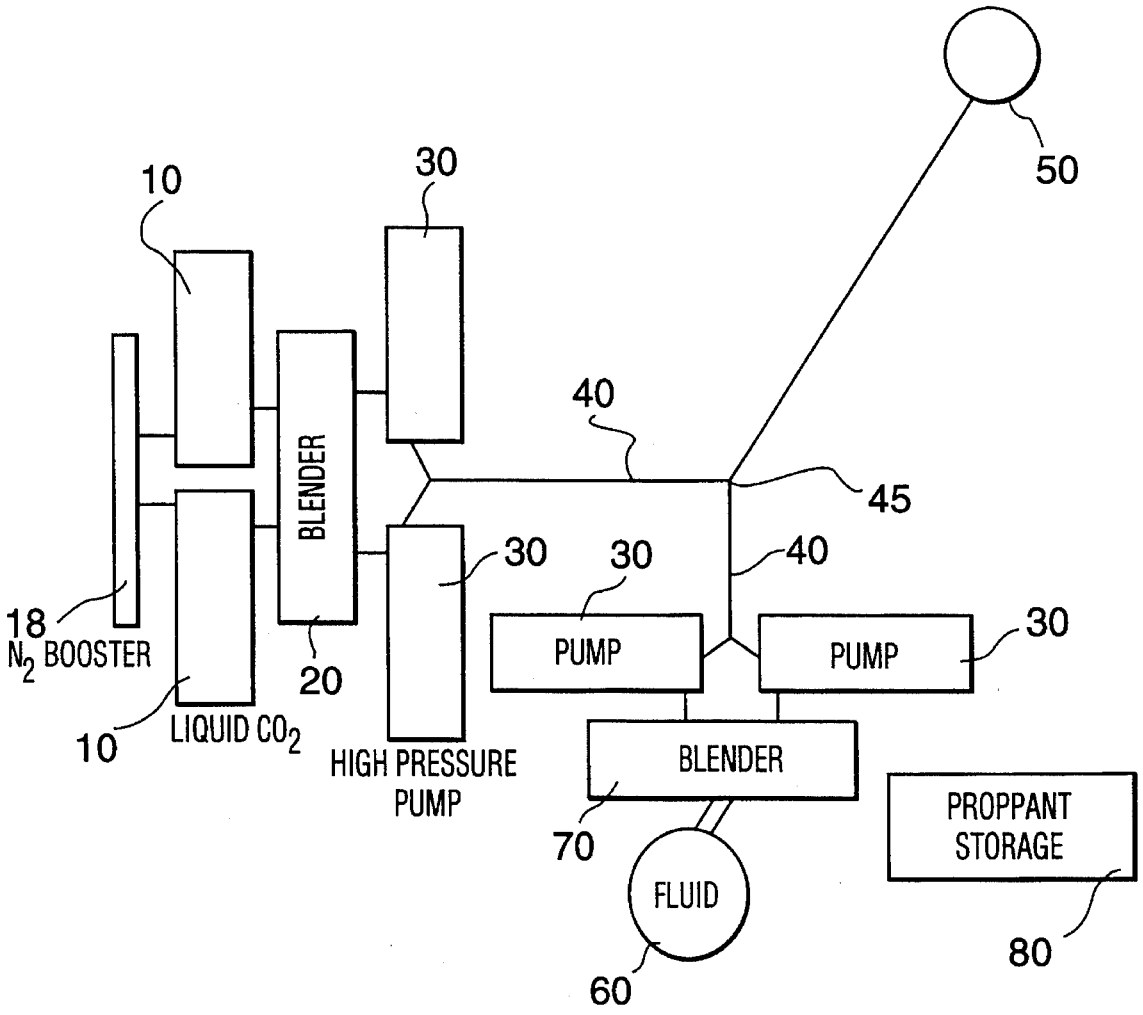
FIG. 6 is a block diagram of the hydraulic fracturing system of the present invention.

Turning more specifically now to the present invention, the methodology involved is similar in outline to that described above with reference to Canadian Patent 1,134,258, including transport to the site of liquid $CO_2$, proppants, conventional frac fluid, storage vessels for the same and of course high pressure fracture pumpers. A typical well site equipment layout is illustrated in FIG. 6. The layout includes a $CO_2$ supply side comprising one or more storage vessels 10 for liquid $CO_2$, a pressure vessel 20 for pressurized storage and blending of the proppants with $CO_2$ from vessels 10 and high pressure fracture pumpers 30 for pumping the $CO_2$/proppant mixture through high pressure supply line 40 to the well head 50 and down the well bore. The layout can additionally include a nitrogen booster 18 for $CO_2$ pressure vessels 20.

The conventional frac fluid supply side includes storage vessel 60 for the fluid, a conventional blender 70 for blending the fluid with proppants taken from proppant transport 80, high pressure pumpers 30 which again are for pumping the fluid with entrained proppants through supply line 40 to the well head.

The intersection 45 in the supply line 40 is the point of initial contact between the streams of $CO_2$ and conventional frac fluid resulting in turbulence to form the liquid $CO_2$/liquid emulsion, additional admixing occurring along the remaining length of the supply line and down the well bore.

Proppants are added simultaneously to the two liquid streams from each of blenders 20 and 70 with final downhole proppant concentrations being controlled by blender proppant concentrations at predetermined $CO_2$ ratios. Proppant concentrations are calculated and combined in each blender to achieve the desired downhole proppant concentration while maintaining $CO_2$ ratios at 50 to 75 percent (%) or higher even at proppant concentrations of 2400 kg/m$^3$ or higher. Proppant concentration i the liquid $CO_2$ stream may vary in the range from an amount in excess of 0 kg/m$^3$ to 1,350 kg/m$^3$ and in the stream of conventional fracturing fluid the range will typically be from an amount in excess of 0 kg/m$^3$ to 3,300 kg/m$^3$. For example, for a frac fluid comprising 75%/25% liquid $CO_2$/cross-linked water-methanol:

(1) 175 kg/m$^3$ downhole proppant concentration desired: 400 kg/m$^3$ water-methanol proppant concentration; 100 kg/m$^3$ liquid $CO_2$ proppant concentration; Then:

(i) 0.75×100 kg/m$^3$+0.25×400 kg/m$^3$=175 kg/m$^3$ downhole proppant concentration.

(2) 1,700 kg/m$^3$ downhole concentration desired: 2,800 kg/m$^3$ water-methanol proppant concentration; 1,335 kg/m$^3$ liquid $CO_2$ proppant concentration; Then:

(ii) 0.75×1,335 kg/m$^3$+0.25×2,800 kg/m$^3$=1,700 kg/m$^3$ downhole proppant concentration.

The concentrations in the two streams may increase at a constant or varying rate and either simultaneously or at varying times throughout the treatment. The concentrations can be increased throughout the treatment, held constant for selected periods, or one or both can be maximized at the same or different times in the treatment.

Conventional frac fluids used in the present process can be one or a mixture of any number of well known water, alcohol or hydrocarbon-based liquids chosen for compatibility with fracture zone petrology, formation fluids and frac fluid constituents. Numerous additives can be included, such as gellants, hydration inhibitors, gel breakers, cross-linking agent and others, all having characteristics and purposes known to those skilled in the art and which therefore need not be further described herein. Blending of proppants with conventional frac fluids is also well known in the art and reference is made in this regard by way of example to Canadian Patents 1,197,977 and 1,242,389. It is also known in the art again with reference to the aforementioned patents that a suitable emulsifier such as a predetermined quantity of a selected surfactant can be used to stabilize the $CO_2$/frac fluid emulsion.

The invention is further illustrated by the following examples:

EXAMPLE 1

A gas well located in township 52 Range 19 West of the fifth meridian in Alberta, Canada was completed with 139.7 mm casing. The lower Cardium (gas) zone was perforated from 2,173.5 to 2,177.0 m. All completion fluid was removed from the well.

Three liquid carbon dioxide ($CO_2$) frac tankers containing 121.0 m$^3$ of liquid $CO_2$ at 2.0 MPa and −20° C. were connected to two high pressure frac pumpers through a pressurized $CO_2$ blender. One standard frac tank containing 23.0 m$^3$ 60% "Aquamaster III"/40% methanol (cross-linked water/methanol system) was connected to a high pressure frac pumper through a conventional blender. There were 11.9 metric tons 40/60 sand loaded in the pressurized $CO_2$ blender prior to pressurizing the blender. The conventional blender had a sand truck spotted with 8.1 tonnes 40/60 sand and 1.0 tonne of 100 mesh sand. The pressurized $CO_2$ blender, frac pumpers, and lines were cooled down with $CO_2$ vapour. All surface lines and frac pumpers were then pressure tested. The hole was filled with 25.7 m$^3$ 80%/20% liquid $CO_2$/cross-linked water-methanol frac fluid. The fracture was initiated and 1 tonne of 100 mesh sand pumped in 11.5 m$^3$ of frac fluid using the conventional blender for the addition of sand. An additional 28.8 m$^3$ of frac fluid was pumped following the 100 mesh sand. The frac fluid was adjusted to 75%/25% liquid $CO_2$/cross-linked water-methanol and 20 tonnes 40/60 sand pumped utilizing both blenders for sand addition. Pressure within the $CO_2$ frac tankers was maintained by displacing the $CO_2$ with $N_2$ during the treatment. The conventional blender sand concentrations ranged from 400 to 2,800 kg/m$^3$ and the pressurized $CO_2$ blender concentrations ranged from 100 to 1,350 kg/m$^3$. The liquid $CO_2$ and cross-linked water-methanol slurries emulsified where the frac lines intersected yielding a downhole proppant concentration which ranged from 175 to 1,700 kg/m$^3$. The proppant concentrations in both blenders were increased in stages simultaneously as shown with reference to Tables I and II indicating the cumulative Proppant/Fluid Schedule and the Blender Streams Proppant Schedule, respectively. The cross-linked water-methanol was pumped at 1.025 m$^3$/min and the liquid $CO_2$ at 3.025 m$^3$/min for a combined frac fluid rate of 4.1 m$^3$/min. Pressures ranged from 14 to 45 MPa. Of the 20 metric tons of 40/60 sand pumped, 17 tonnes were placed into the formation by flushing the well with 100% liquid $CO_2$. The well was shut in for four hours and then flowed back for cleanup.

TABLE I

PROPPANT FLUID SCHEDULE

| Stage | Cum Fluid (m$^3$) | Fluid Stage (m$^3$) | Sand Conc. (kg/m$^3$) | Sand (kg/ Stage) | Cum Sand (kg) |
|---|---|---|---|---|---|
| Hole(Frac Fluid) | 26.4 | 26.4 | | | |
| Pad (Start 100 Mesh Sand) | 36.4 | 10.0 | 100 | 1,000 | 1,000 |
| Pad(Frac Fluid) | 66.4 | 30.0 | | | |
| Start 40/60 Sand | 68.4 | 2.0 | 175 | 350 | 350 |
| Increase 40/60 Sand | 70.4 | 2.0 | 325 | 650 | 1,000 |
| Increase 40/60 Sand | 72.4 | 2.0 | 550 | 1,100 | 2,100 |
| Increase 40/60 Sand | 75.4 | 3.0 | 775 | 2,325 | 4,425 |
| Increase 40/60 Sand | 78.4 | 3.0 | 1,000 | 3,000 | 7,425 |
| Increase 40/60 Sand | 81.4 | 3.0 | 1,225 | 3,675 | 11,100 |
| Increase 40/60 Sand | 83.4 | 2.0 | 1,150 | 2,900 | 14,000 |
| Increase 40/60 Sand | 85.4 | 2.0 | 1,600 | 3,200 | 17,200 |
| Increase 40/60 Sand | 87.1 | 1.7 | 1,700 | 2,800 | 20,000 |
| Flush (Liquid CO2) | 25.4 | 25.4 | | | |

TABLE II

BLENDER STREAMS PROPPANT SCHEDULE

| | "AQUAMASTER III" Plus Methanol | | | Liquid $CO_2$ | | | Liquid CO2/ "AQUAMASTER III" Plus Methanol |
|---|---|---|---|---|---|---|---|
| Stage | Cum Water/ Methanol (m$^3$) | Water/ Methanol Stage (m$^3$) | Sand Conc. (kg/m$^3$) | Cum Liquid $CO_2$ (m$^3$) | Liquid $CO_2$ Stage (m$^3$) | Sand Conc. (kg/m$^3$) | Liquid $CO_2$ Conc. (%) |
| Hole(Frac Fluid) | 5.3 | 5.3 | | 21.1 | 21.1 | | 80 |
| Pad (Start 100 Mesh Sand) | 7.3 | 2.0 | 500 | 29.1 | 8.0 | | 80 |

TABLE II-continued

BLENDER STREAMS PROPPANT SCHEDULE

| Stage | "AQUAMASTER III" Plus Methanol | | | Liquid $CO_2$ | | | Liquid CO2/ "AQUAMASTER III" Plus Methanol |
|---|---|---|---|---|---|---|---|
| | Cum Water/ Methanol ($m^3$) | Water/ Methanol Stage ($m^3$) | Sand Conc. ($kg/m^3$) | Cum Liquid $CO_2$ ($m^3$) | Liquid $CO_2$ Stage ($m^3$) | Sand Conc. ($kg/m^3$) | Liquid $CO_2$ Conc. (%) |
| Pad(Frac Fluid) | 13.3 | 6.0 | | 53.1 | 24.0 | | 80 |
| Start 40/60 Sand | 13.8 | 0.5 | 400 | 54.6 | 1.5 | 100 | 75 |
| Increase 40/60 Sand | 14.3 | 0.5 | 700 | 56.1 | 1.5 | 200 | 75 |
| Increase 40/60 Sand | 14.8 | 0.5 | 1,000 | 57.6 | 1.5 | 400 | 75 |
| Increase 40/60 Sand | 15.6 | 0.8 | 1,300 | 59.8 | 2.2 | 600 | 75 |
| Increase 40/60 Sand | 16.4 | 0.8 | 1,600 | 62.0 | 2.2 | 800 | 75 |
| Increase 40/60 Sand | 17.2 | 0.8 | 1,900 | 64.2 | 2.2 | 1,000 | 75 |
| Increase 40/60 Sand | 17.7 | 0.5 | 2,200 | 65.7 | 1.5 | 1,200 | 75 |
| Increase 40/60 Sand | 18.2 | 0.5 | 2,500 | 67.2 | 1.5 | 1,300 | 75 |
| Increase 40/60 Sand | 18.6 | 0.4 | 2,800 | 68.5 | 1.3 | 1,350 | 75 |
| Flush (Liquid CO2) | | | | 93.9 | 25.4 | | 100 |

EXAMPLE #2

A gas well located in township 52 Range 19 West of the fifth meridian in Alberta, Canada was completed with 139.7 mm casing. The lower Cardium (gas) zone was perforated from 2,195.5 to 2,200.5 m. All completion fluid was removed from the well.

Three liquid carbon dioxide ($CO_2$) frac tankers containing 129.0 $m^3$ of liquid $CO_2$ at 2.0 MPa and −20° C. were connected to three high pressure frac pumpers through a pressurized $CO_2$ blender. One standard frac tank containing 26.0 $m^3$ 60% "Aquamaster III"/40% methanol (cross-linked water/methanol system) was connected to a high pressure frac pumper through a conventional blender. There were 11.9 metric tons 40/60 sand loaded in the pressurized $CO_2$ blender prior to pressurizing the blender. The conventional blender had a sand truck spotted with 8.1 metric tons 40/60 sand and 1.0 ton of 100 mesh sand. The pressurized $CO_2$ blender, frac pumpers, and lines were cooled down with $CO_2$ vapour. All surface lines and frac pumpers were then pressure tested. The hole was filled with 26.0 $m^3$ 80%/20% liquid $CO_2$/cross-linked water-methanol frac fluid. The fracture was initiated with 6.5 $m^3$ frac fluid and 1 tonne of 100 mesh sand pumped in 12.5 $m^3$ of frac fluid using the conventional blender for the addition of sand. An additional 29.5 $m^3$ of frac fluid was pumped following the 100 mesh sand. The frac fluid was adjusted to 75%/25% liquid $CO_2$/cross-linked water-methanol and 20 tonnes 40/60 sand pumped utilizing both blenders for sand addition. Pressure within the $CO_2$ frac tankers was maintained by displacing the $CO_2$ with $N_2$ during the treatment. The conventional blender sand concentrations ranged from 400 to 2,800 $kg/m^3$ and the pressurized $CO_2$ blender concentrations ranged from 100 to 1,350 $kg/m^3$. The liquid $CO_2$ and cross-linked water-methanol slurries emulsified where the frac lines intersected yielding a downhole proppant concentration which ranged from 175 to 1,700 $kg/m^3$. The proppant concentrations in both blenders were increased in stages simultaneously as shown with reference to Tables III and IV indicating the cumulative Proppant Fluid Schedule and the Blender Streams Proppant Schedule, respectively. The cross-linked water-methanol was pumped at 1.125 $m^3$/min and the liquid $CO_2$ at 3.375 $m^3$/min for a combined frac fluid rate of 4.5 $m^3$/min. Pressures ranged from 13 to 22 MPa. Of the 20 tonnes of 40/60 sand pumped, 19 tonnes were placed into the formation by flushing the well with 100% liquid $CO_2$. The well was shut in for four hours and then flowed back for cleanup.

TABLE III

PROPPANT FLUID SCHEDULE

| Stage | Cum Fluid ($m^3$) | Fluid Stage ($m^3$) | Sand Conc. ($kg/m^3$) | Sand (kg/ Stage) | Cum Sand (kg) |
|---|---|---|---|---|---|
| Hole(Frac Fluid) | 26.6 | 26.6 | | | |
| Pad(Frac Fluid) | 33.0 | 6.4 | | | |
| Pad (Start 100 Mesh Sand) | 45.5 | 12.5 | 80 | 1,000 | 1,000 |
| Pad(Frac Fluid) | 75.0 | 29.5 | | | |
| Start 40/60 Sand | 77.0 | 2.0 | 175 | 350 | 350 |
| Increase 40/60 Sand | 79.0 | 2.0 | 325 | 650 | 1,000 |
| Increase 40/60 Sand | 81.0 | 2.0 | 550 | 1,100 | 2,100 |
| Increase 40/60 Sand | 84.0 | 3.0 | 775 | 2,325 | 4,425 |
| Increase 40/60 Sand | 87.0 | 3.0 | 1,000 | 3,000 | 7,425 |
| Increase 40/60 Sand | 90.0 | 3.0 | 1,225 | 3,675 | 11,100 |
| Increase 40/60 Sand | 92.0 | 2.0 | 1,450 | 2,900 | 14,000 |
| Increase 40/60 Sand | 94.0 | 2.0 | 1,600 | 3,200 | 17,200 |
| Increase 40/60 Sand | 95.7 | 1.7 | 1,700 | 2,800 | 20,000 |
| Flush (Liquid CO2) | 25.6 | 25.6 | | | |

TABLE IV

BLENDER STREAMS PROPPANT SCHEDULE

| Stage | "AQUAMASTER III" Plus Methanol | | | Liquid $CO_2$ | | | Liquid CO2/ "AQUAMASTER III" Plus Methanol |
|---|---|---|---|---|---|---|---|
| | Cum Water/ Methanol ($m^3$) | Water/ Methanol Stage ($m^3$) | Sand Conc. ($kg/m^3$) | Cum Liquid $CO_2$ ($m^3$) | Liquid $CO_2$ Stage ($m^3$) | Sand Conc. ($kg/m^3$) | Liquid $CO_2$ Conc. (%) |
| Hole(Frac Fluid) | 5.3 | 5.3 | | 21.3 | 21.3 | | 80 |
| Pad(Frac Fluid) | 6.6 | 1.3 | | 26.4 | 5.1 | | 80 |
| Pad (Start 100 Mesh Sand) | 9.1 | 2.5 | 400 | 36.4 | 10.0 | | 80 |
| Pad(Frac Fluid) | 15.0 | 5.9 | | 60.0 | 23.6 | | 80 |
| Start 40/60 Sand | 15.5 | 0.5 | 400 | 61.5 | 1.5 | 100 | 75 |
| Increase 40/60 Sand | 16.0 | 0.5 | 700 | 63.0 | 1.5 | 200 | 75 |
| Increase 40/60 Sand | 16.5 | 0.5 | 1,000 | 64.5 | 1.5 | 400 | 75 |
| Increase 40/60 Sand | 17.3 | 0.8 | 1,300 | 66.7 | 2.2 | 600 | 75 |
| Increase 40/60 Sand | 18.1 | 0.8 | 1,600 | 68.9 | 2.2 | 800 | 75 |
| Increase 40/60 Sand | 18.9 | 0.8 | 1,900 | 71.1 | 2.2 | 1,000 | 75 |
| Increase 40/60 Sand | 19.4 | 0.5 | 2,200 | 72.6 | 1.5 | 1,200 | 75 |
| Increase 40/60 Sand | 19.9 | 0.5 | 2,500 | 74.1 | 1.5 | 1,300 | 75 |
| Increase 40/60 Sand | 20.3 | 0.4 | 2,800 | 75.4 | 1.3 | 1,350 | 75 |
| Flush (Liquid CO2) | | | | 101.0 | 25.6 | | 100 |

The above-described embodiments of the present invention are meant to be illustrative of preferred embodiments of the present invention and are not intended to limit the scope of the present invention. Various modifications, which would be readily apparent to one skilled in the art, are intended to De within the scope of the present invention. The only limitations to the scope of the present invention are set out in the following appended claims.

We claim:

1. A method of fracturing an underground formation penetrated by a well bore comprising the steps of:

forming a first pressurized stream of liquified gas;

introducing proppants into said first stream for transport of said proppants in said first stream;

pressurizing and cooling said proppants to substantially the storage pressure and temperature of said liquified gas prior to introducing said proppants into said first stream;

forming a second pressurized stream of fracturing fluid;

introducing proppants into said second stream for transport therein; and admixing said first and second streams to form an emulsion for injection into said formation at a rate and pressure to cause the fracturing thereof.

2. The method of claim 1 wherein said first and second streams are injected into said formation by means of high pressure pump means, said proppants being introduced into said first and second streams prior to pumping by said high pressure pump means.

3. The method of claim 2 wherein said proppants introduced into said first stream are cooled using said liquified gas.

4. The method of claim 3 wherein said proppant is present in said first and second streams in predetermined concentrations.

5. The method of claim 4 wherein said predetermined concentrations of proppant in said first and second streams may be varied during fracturing of said underground formation.

6. The method of claim 5 wherein said predetermined concentrations of proppant in each of said first and second streams may be varied at equal or unequal rates and at different times during said fracturing of said formation.

7. The method of claim 6 wherein said predetermined concentration of said proppant in said first stream may be less than, equal to or in excess of said proppant concentration in said second stream at different times during said fracturing of said formation.

8. The method of claim 7 wherein the ratio of said liquified gas in said emulsion is maintained above at least 50% during fracturing of said formation.

9. The method of claim 8 wherein the ratio of said liquified gas in said emulsion is maintained above at least 70% during fracturing of said formation.

10. The method of claim 9 wherein the ratio of said liquified gas in said emulsion is maintained above at least 75% during fracturing of said formation.

11. The method of claim 10 wherein said liquified gas is liquid carbon dioxide.

12. The method of claim 11 wherein said fracturing fluid comprises one or more liquids selected from the group consisting of water, alcohol or hydrocarbons.

13. The method of claim 12 wherein said emulsion is injected into said well bore at a temperature below the critical temperature of said liquefied gas.

14. The method of claim 13 wherein said concentration of said proppant in said first stream varies in the range from an amount in excess of 0 $kg/m^3$ to 1,350 $kg/m^3$.

15. The method of claim 14 wherein said concentration of said proppant in said second stream varies in the range from an amount in excess of 0 $kg/m^3$ to 3,300 $kg/m^3$.

16. A method of propping open a hydraulically fractured underground formation penetrated by a well bore comprising the steps of:

introducing propping agents into a first stream of pressurized liquified gas, said propping agents having been previously pressurized and cooled to the pressure and temperature of said liquified gas, respectively;

introducing propping agents into a second stream of liquid fracturing fluid;

pressurizing said second stream;

admixing said first and second streams to form an emulsion; and pumping said emulsion into said formation at a rate and pressure sufficient to deposit said proppants in fractures formed in said formation.

17. A method of fracturing an underground formation penetrated by a well bore comprising the steps of:

adding proppants to a first stream of liquified gas, said proppants being pressurized and cooled to substantially the pressure and temperature of said liquified gas prior to the addition thereof to said first stream;

pressurizing said first stream for injection into said formation;

adding proppants to a second stream of liquid fracturing fluid;

pressurizing said second stream for injection into said formation; and mixing said first and second streams to form an emulsion prior to injection thereof into said formation at a rate and pressure sufficient to cause the fracturing thereof.

18. The method of claim 17 wherein said first and second streams are pressurized for injection into said formation by means of high pressure pump means, said proppants being introduced into said first and second streams prior to pressurization thereof by said high pressure pump means.

19. The method of claim 18 wherein said proppants introduced into said first stream are cooled using said liquified gas.

20. The method of claim 19 wherein said proppant is present in said first and second streams in predetermined concentrations.

21. The method of claim 20 wherein said predetermined concentrations of proppant in said first and second streams may be varied during fracturing of said underground formation.

22. The method of claim 21 wherein said predetermined concentrations of proppant in each of said first and second streams may be varied at equal or unequal rates and at different times during said fracturing of said formation.

23. The method of claim 22 wherein said predetermined concentration of said proppant in said first stream may be less than, equal to or in excess of said proppant concentration in said second stream at different times during said fracturing of said formation.

24. The method of claim 23 wherein the ratio of said liquified gas in said emulsion is maintained above at least 50% during fracturing of said formation.

25. The method of claim 24 wherein the ratio of said liquified gas in said emulsion is maintained above at least 70% during fracturing of said formation.

26. The method of claim 25 wherein the ratio of said liquified gas in said emulsion is maintained above at least 75% during fracturing of said formation.

27. The method of claim 26 wherein said liquified gas is liquid carbon dioxide.

28. The method of claim 27 wherein said fracturing fluid comprises one or more liquids selected from the group consisting of water, alcohol or hydrocarbons.

29. The method of claim 28 where in said emulsion is injected into said well bore at a temperature below the critical temperature of said liquefied gas.

30. The method of claim 29 wherein said concentration of said proppant in said first stream varies in the range from an amount in excess of 0 $kg/m^3$ to 1,350 $kg/m^3$.

31. The method of claim 30 wherein said concentration of said proppant in said second stream varies in the range from an amount in excess of 0 $kg/m^3$ to 3,300 $kg/m^3$.

32. Apparatus for hydraulically fracturing an underground formation penetrated by a well bore comprising:

high pressure pump means for injecting a first stream of liquified gas down said well bore;

first storage means to store said liquified gas under pressure;

conduit means to provide fluid communication between said pump means and said first storage means;

second storage means to store proppants at a temperature and pressure substantially equal to the storage pressure and temperature of said liquified gas;

blender means to blend said proppants from said second storage means into said first stream prior to injection thereof down said well bore;

second high pressure pump means for injecting a second stream of fracturing fluid down said well bore, said second stream comprising a liquid;

third storage means to store said liquid;

fourth storage means to store said proppants;

second blender means for blending proppants from said fourth storage means with fracturing fluid from said third storage means;

second conduit means to provide fluid communication between said second pump means and said second blender means; and high pressure supply lines to provide fluid communication between said first and second pump means and said well bore, said supply lines from said first and second pump means intersecting one another prior to said well bore for admixing of said first and second streams flowing therein before injection thereof down said well bore.

* * * * *

UNITED STATES PATENT AND TRADEMARK OFFICE

CERTIFICATE OF CORRECTION

PATENT NO. : 5,515,920

DATED : May 14, 1996

INVENTOR(S) : Samuel W. M. Luk

It is certified that error appears in the above-identified patent and that said Letters Patent is hereby corrected as shown below:

Column 8, in the 4th column of the 11th line of Table 1, delete "1,150" and insert therefor --1,450--.

Signed and Sealed this

Twentieth Day of August, 1996

Bruce Lehman

BRUCE LEHMAN

*Commissioner of Patents and Trademarks*

*Attest:*

*Attesting Officer*